US006769378B1

(12) United States Patent
Dang

(10) Patent No.: US 6,769,378 B1
(45) Date of Patent: Aug. 3, 2004

(54) PORTABLE SELF-RESCUE DEVICE FOR KAYAKERS

(76) Inventor: Philip S. Dang, 45-653 Uhilehua Pl., Kaneohe, HI (US) 96744

( * ) Notice: Subject to any disclaimer, the term of this patent is extended or adjusted under 35 U.S.C. 154(b) by 0 days.

(21) Appl. No.: 10/732,458

(22) Filed: Dec. 11, 2003

(51) Int. Cl.[7] ..... B63H 16/04
(52) U.S. Cl. ..... 114/347; 114/362
(58) Field of Search ..... 114/347, 362

(56) References Cited

U.S. PATENT DOCUMENTS

| | | | | |
|---|---|---|---|---|
| 1,369,670 A | | 2/1921 | Kauffman | |
| 3,537,417 A | | 11/1970 | Beckner | 114/123 |
| 4,117,795 A | | 10/1978 | Ruiz | 114/68 |
| 4,700,650 A | | 10/1987 | Nishida | 114/125 |
| 4,807,551 A | | 2/1989 | Ace | 114/123 |
| 4,936,236 A | | 6/1990 | Sinden | 114/39.1 |
| 4,977,844 A | | 12/1990 | Barr | 114/123 |
| 5,189,974 A | * | 3/1993 | Masters | 114/61.15 |
| 5,279,248 A | | 1/1994 | Blachford | 114/347 |
| 5,542,369 A | | 8/1996 | Ingram | 114/347 |
| 6,129,600 A | | 10/2000 | Nordby | 440/101 |
| D457,121 S | | 5/2002 | Gyzybowski | D12/317 |
| 6,386,130 B1 | | 5/2002 | Kuehne | 114/39.26 |
| 6,533,626 B2 | | 3/2003 | Pons | 441/80 |

* cited by examiner

*Primary Examiner*—Ed Swinehart
(74) *Attorney, Agent, or Firm*—Richard C. Litman

(57) ABSTRACT

A portable self-rescue device for a capsized kayaker used in combination with a kayak, on a body of water. The invention has an extendible telescopic arm with a proximal end and a distal end, a collapsible container attached to the distal end of the extendible telescopic arm and a collapsible ladder platform assembly with a retractable step. The extendible telescopic arm acts as a lever and the collapsible container fills rapidly with water and acts as a weight that counters the weight of a capsized kayaker as he or she climbs onto the collapsible ladder platform assembly on the opposite side of the kayak.

8 Claims, 8 Drawing Sheets

PORTABLE SELF-RESCUE DEVICE FOR KAYAKERS

BACKGROUND OF THE INVENTION

1. Field of the Invention

The present invention relates generally to a boating safety device. More particularly, the invention is a portable self-rescue device for kayakers.

2. Description of the Related Art

Kayaking is an exciting and action-packed sport that has gained popularity in this country, especially in the Western part of the United States. Unfortunately, like many exciting sports, kayaking can also be very dangerous, especially for inexperienced kayakers. There are a variety of boating safety devices for kayakers and other types of watercraft which are reflected in the related art.

U.S. Pat. No. Des. 457,121 issued to Gyzybowski on May 14, 2002, outlines the use of an ornamental design for a watercraft stabilizer.

U.S. Pat. No. 1,369,670 issued to Kauffman on Feb. 22, 1921, outlines the use of an attachment for light watercraft, such as boats, and has for its primary objective to provide these boats with outriggers to prevent the upsetting of the watercraft.

U.S. Pat. No. 3,537,417 issued to Beckner on Nov. 3, 1970, outlines the use of a stabilizer unit for canoes having a pair of rigid support elements and a pair of connector members, each extending between common opposite ends of the support elements. A polyurethane foam stabilizer float is carried by and encloses a portion of each of the connector members.

U.S. Pat. No. 4,117,795 issued to Ruiz on Oct. 3, 1978, outlines the use of a marine craft maintained floating in a capsized condition by floatation components which permit angular displacement substantially about a rotational axis established intermediate to the bow and stern. Venting of air entrapped within the craft forwardly of the rotational axis initiates angular displacement of the hull until the marine craft assumes a stabilized position intermediate to the capsized and the upright positions.

U.S. Pat. No. 4,700,650 issued to Nishida on Oct. 20, 1987, outlines the use of an arrangement for returning a small boat from an overturned position to a normal upright position. The boat has a substantially enclosed room and a partition provided in the room adjacent the bottom of the craft to form in the room an upper compartment and a lower compartment under the upper compartment. The lower compartment is adapted to contain water and the partition is adapted to substantially prevent the water from entering the upper compartment when the marine craft is overturned.

U.S. Pat. No. 4,807,551 issued to Ace on Feb. 28, 1989, outlines the use of a portable outrigger assembly particularly useful on a canoe. The assembly has a pontoon and a supporting structure of first and second supports for the pontoon. The first set of supports includes adjustable clamping assemblies for clamping to both sides of the canoe with the first set of supports extending generally horizontally outwardly from only one side of the canoe.

U.S. Pat. No. 4,936,236 issued to Sinden on Jun. 26, 1990, outlines the use of a fully symmetrical sailboat that includes a mechanism that balances the moment of a sailor on a boom against the force of the wind on the sail in such a way that the hull remains level. The sailboat has a hull with both lateral and longitudinal symmetry and a rig with a short and rotatable mast.

U.S. Pat. No. 4,977,844 issued to Barr on Dec. 18, 1990, outlines the use of a safety device for small watercraft, especially for canoes, with an extensible stabilizing float of the outrigger-type. The float is shaped to conform to the side of the hull and is stored thereagainst while transporting or portaging the canoe or traveling in the canoe in moderate weather. The stabilizing float is deployed whenever stability is required, permitting one to stand in the canoe or haul objects from the water without the fear of tipping over.

U.S. Pat. No. 5,279,248 issued to Blachford on Jan. 18, 1994, outlines a method and use of an apparatus for reducing the skill required of a paddler to right a capsized kayak without exiting it and to avoid the dangers associated with exiting a kayak after being capsized. In broad terms, the paddler is provided with a simple and rapid way of creating a buoyant force to one side of the capsized kayak, which can be used to produce a generous amount of torque for righting.

U.S. Pat. No. 5,542,369 issued to Ingram on Aug. 6, 1996, outlines the use of a kayak safety buoyancy stirrup with an adjustable stirrup and an inflatable buoyancy bag flexibly attached to the deck of a kayak, permitting immediate deployment by a kayaker in the water on either side of the kayak. The buoyancy stirrup has sufficient buoyancy to allow a disabled kayaker to step out of the water immediately to prevent hypothermia and to lie across the device and the kayak deck in extreme emergencies.

U.S. Pat. No. 6,129,600 issued to Nordby on Oct. 10, 2000, outlines the use of a paddle floatation apparatus with a unitary inflatable sleeve that fits over a kayak or other shallow draft watercraft paddle blade. When installed on a paddle blade, the entire paddle may be configured as an outrigger to assist the user in righting the kayak and reentering the cockpit from the water.

U.S. Pat. No. 6,386,130 issued to Kuehne on May 14, 2002, outlines a control system for a sailing vessel for controlling the position of the sail and the rudder, and being affixed to a slidable seat apparatus. A movement of the seat apparatus does not alter the position of the sail or the rudder. A ballast control, steering control and sail control are located on the slidable seat apparatus.

U.S. Pat. No. 6,533,626 issued to Pons on Mar. 18, 2003, outlines the use of an on-board device for rescuing a person from the sea, enabling a conscious person to rescue himself or herself. A floating trailing end is adapted to be recovered by the person in the sea and serves as a control to actuate the release of a floating towrope element. The floating element is connected to the boat by an end serving as a towrope and a shock absorber. The floatation element is provided with towrope attachments and is symmetrical and has a hydrodynamic shape.

Although each of the devices outlined in these patents are useful and novel, what is really needed is an easy to use self-rescuing device that is specifically designed for kayaks. Such a device would be well-received and would meet a high demand in the marketplace.

None of the above inventions and patents, taken either singly or in combination, is seen to describe the instant invention as claimed. Thus a portable self-rescue device for kayakers solving the aforementioned problems is desired.

SUMMARY OF THE INVENTION

The invention is a portable self-rescue device for a capsized kayaker used in combination with a kayak, on a body of water. The invention has an extendible telescopic arm with a proximal end and a distal end, a collapsible container attached to the distal end of the extendible telescopic arm and a collapsible ladder platform assembly with a retractable step. The extendible telescopic arm acts as a lever and the collapsible container fills with water and acts as a weight that counters a capsized kayaker as he or she climbs on the collapsible ladder platform assembly on the opposite side of the kayak.

Accordingly, it is a principal object of the invention to provide a rapidly deployable self-rescue device for kayakers when their kayaks capsize.

It is another object of the invention to provide a self-rescue device for kayakers that is easy to deploy and use.

It is a further object of the invention to provide a self-rescue device for kayakers that is easily transportable on a kayak.

Still another object of the invention is to provide a self-rescue device that can be retrofit on existing kayaks.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
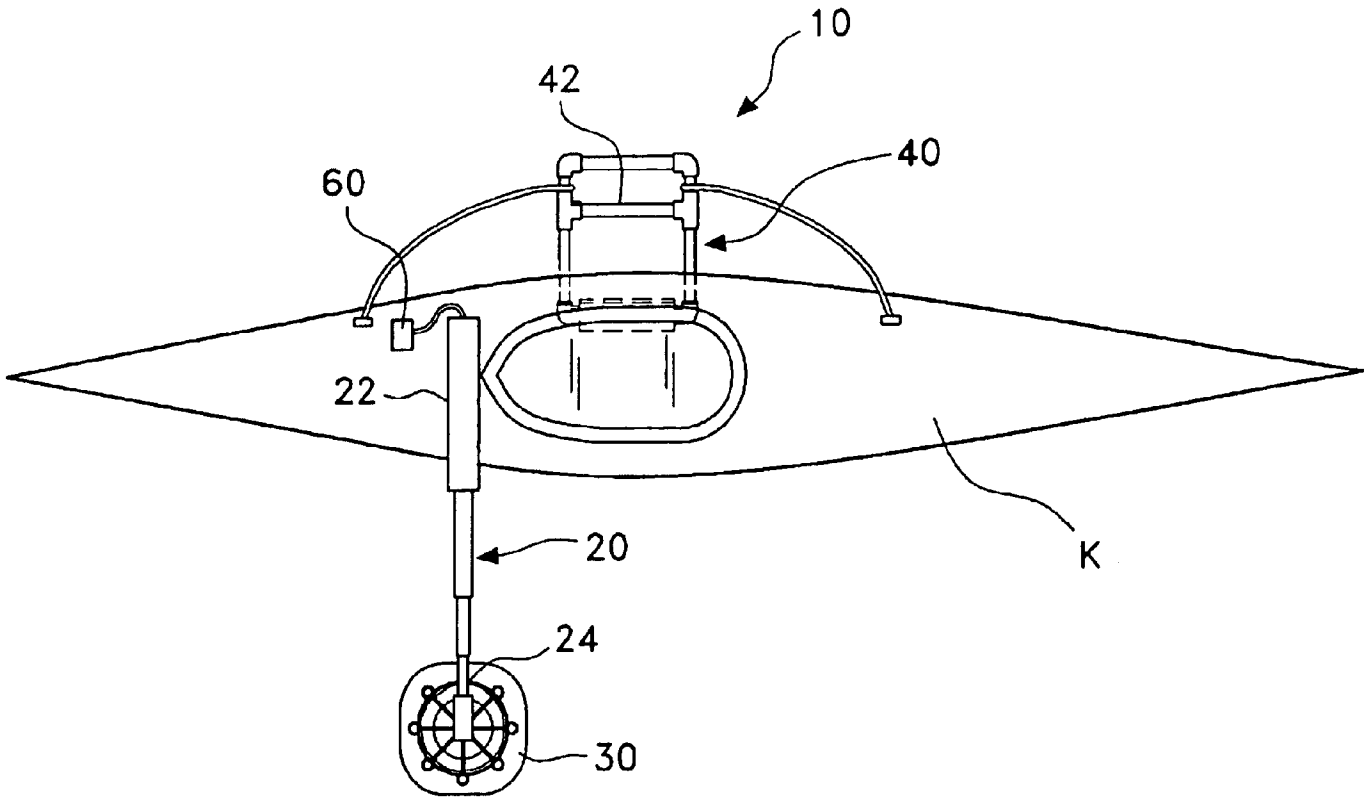
FIG. 1 is an overhead perspective view of the portable self-rescue device for kayakers.

The present invention is a portable self-rescue device for a capsized kayaker 10 used in combination with a kayak K, as is shown in FIG. 1.

The portable self-rescue device for a capsized kayaker 10 comprises an extendible telescopic arm 20 with a proximal end 22 and a distal end 24, a collapsible container 30 attached to the distal end 24 of the extendible telescopic arm 20 and a collapsible ladder platform assembly 40 with a retractable step 42 for a capsized kayaker K to throw and extend the extendible telescopic arm 20 and collapsible container 30 over the kayak K and into the body of water, allowing the collapsible container 30 to take on water using the extendible telescopic arm 20 as a lever, the filled collapsible container 30 acting as a counterweight and the kayak K acting as a fulcrum for the capsized kayaker to receive additional leverage and to get on the deployed collapsible ladder platform assembly 40 and back into the kayak K. These components of the portable self-rescue device for a capsized kayaker 10 are also depicted in FIG. 1.

Figure 2:
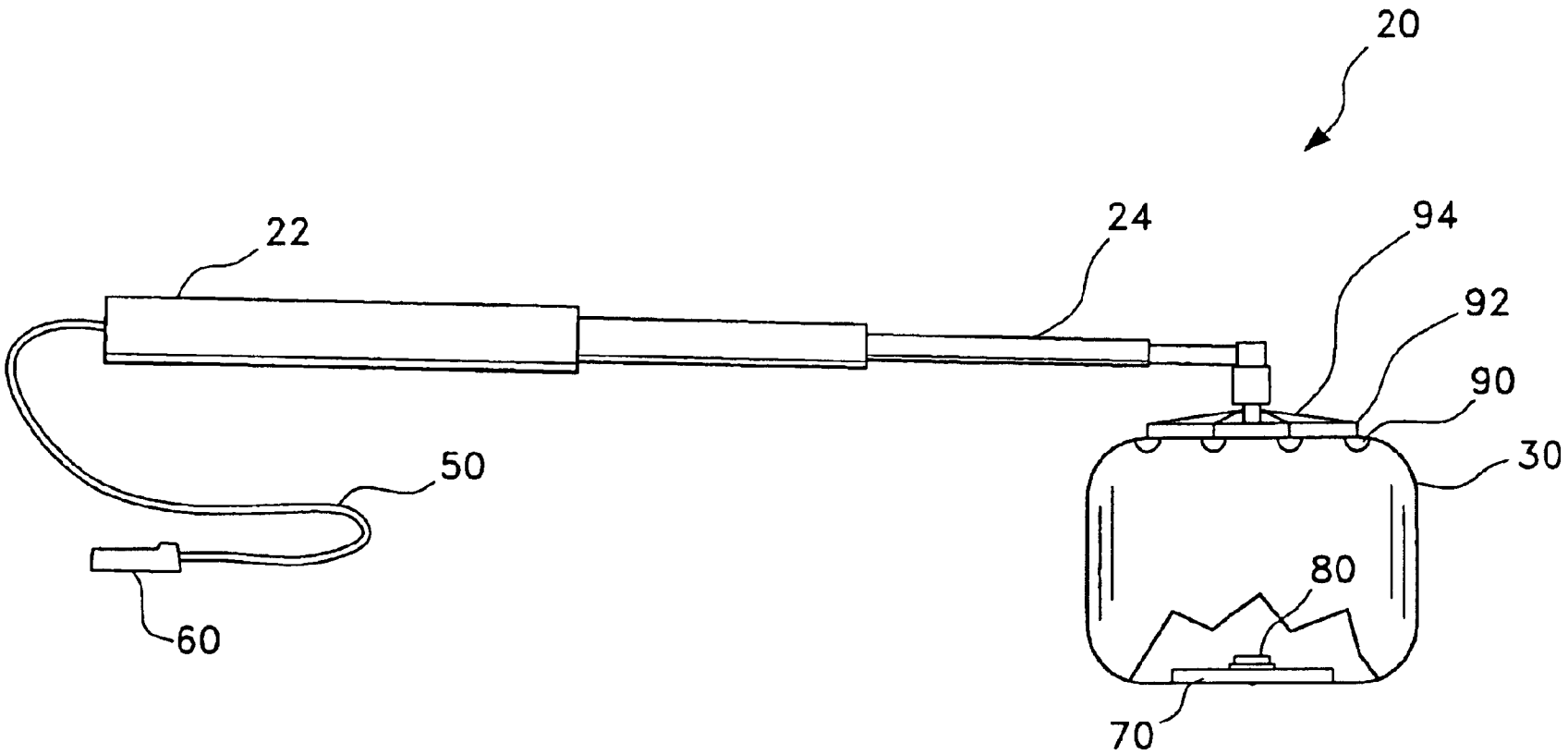
FIG. 2 is a side perspective view of a telescopic arm and container of the portable self-rescue device for kayakers.

FIG. 2 illustrates an isolated drawing of the extendible telescopic arm 20. A first rope 50 that is attached to the proximal end 22 of the extendible telescopic arm 20 to the kayak K is provided to prevent the extendible telescopic arm 20 and the attached collapsible container 30 from floating away from the kayak K while in the water and provides a way to tightly cinch the proximal end 22 to the kayak K. Specifically, a clam cleat 60 is used to attach the first rope 50 to the outside of the kayak K.

The portable self-rescue device for a capsized kayaker 10 also has a significantly large one-way flapper valve 70 provided within the collapsible container 30 that allows water from the body of water to rapidly fill into the collapsible container 30. To further facilitate water filling into the collapsible container 30, the portable self-rescue device for a capsized kayaker 10 has a small lead weight 80 provided within the collapsible container 30 to neutralize the slight positive buoyancy of the collapsible container material 30 and to stabilize the proper orientation of the collapsible container 30 as it is lifting towards the surface of the water.

The rapid filling of the collapsible container 30 is critical to the successful use of the portable self-rescue device for a capsized kayaker 10 since this water will be the weight that counters the weight of the kayaker K while he or she is trying to get back into the kayak K. This and other critical steps will be outlined in the discussion of FIGS. 4A, 4B, 4C, 4D and 4E.

The collapsible container 30 is attached to the distal end 24 of the extendible telescopic arm 20 with a plurality of grommets 90, a metallic ring 92 and a Dacron™ cord 94. This arrangement evenly distributes the tension on the collapsible container 30 to the grommets 90, the metallic ring 92 and the Dacron™ cord 94 for strength and to reduce the possibility of tearing the collapsible container 30 away from the distal end 24 of the extendible telescopic arm 20.

Figure 3:
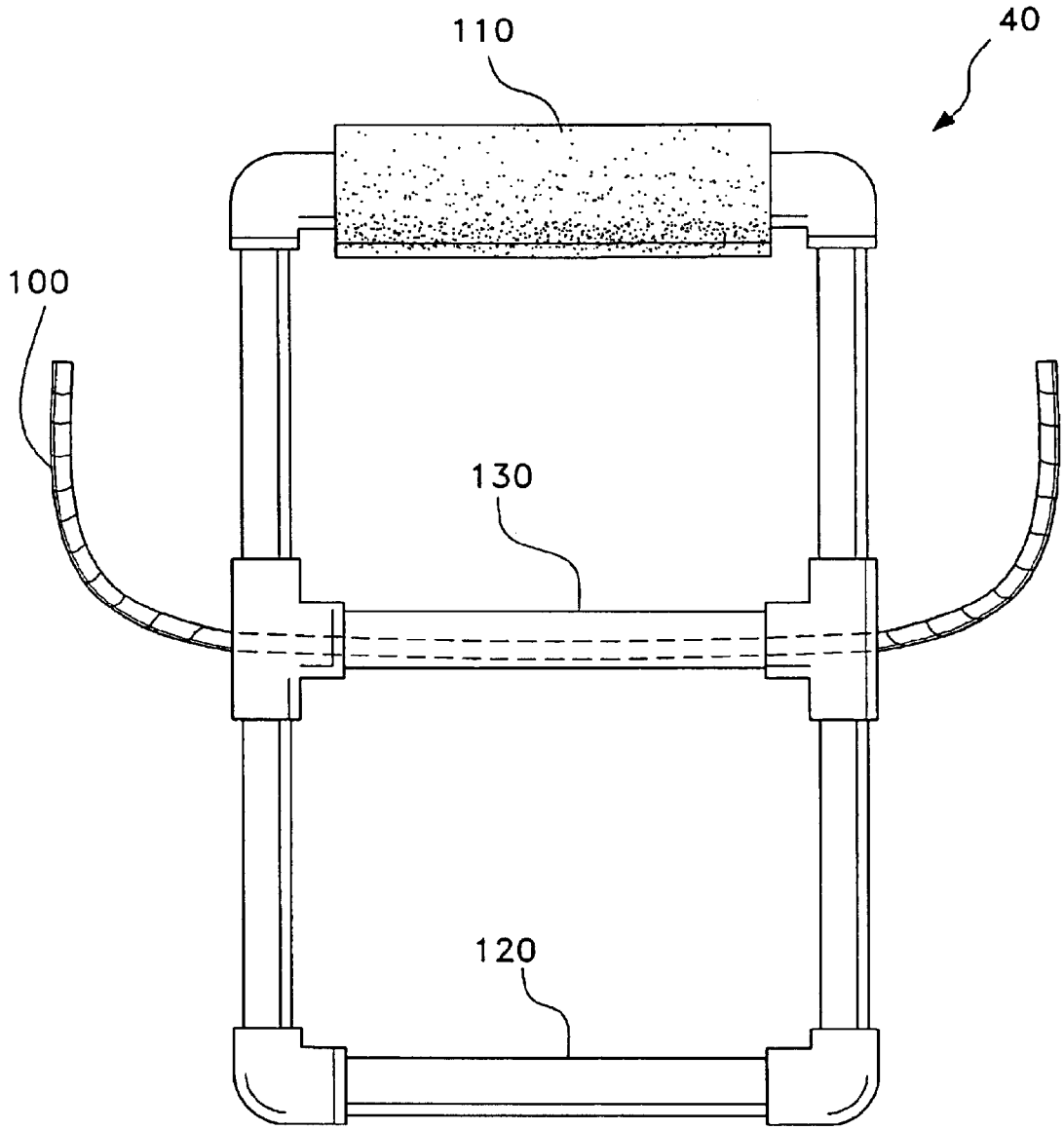
FIG. 3 is a front perspective view of a collapsible ladder platform assembly of the portable self-rescue device for kayakers.

FIG. 3 depicts an isolated collapsible ladder platform assembly 40 of the portable self-rescue device for a capsized kayaker 10. There is a second rope 100 that attaches to the collapsible ladder platform assembly 40 to the kayak K to prevent the collapsible ladder platform assembly 40 from floating away from the kayak K while in the water and also tightly secures the midpoint of the ladder firmly to the kayak K. There is also a floatation pad 110 provided on the collapsible ladder platform assembly 40 to prevent the collapsible ladder platform assembly 40 from sinking while in the body of water and also provide a positive buoyant stabilizing force to hold one end of the collapsible ladder platform assembly 40 to the underside of the kayak K. The collapsible ladder platform assembly 40 is allowed to slide along the second rope 100 fore and aft, from a stored position on the kayak K, to a deployed position adjacent to the side of the kayak K cockpit. The collapsible ladder platform assembly 40 is also retractable to extend outward to form a second step 120 that can be used by a capsized kayaker to grab onto and to pull themselves up by. There is also a middle step 130 between the floatation pad 110 and the second step 120 to further facilitate a capsized kayaker.

Figure 4A:
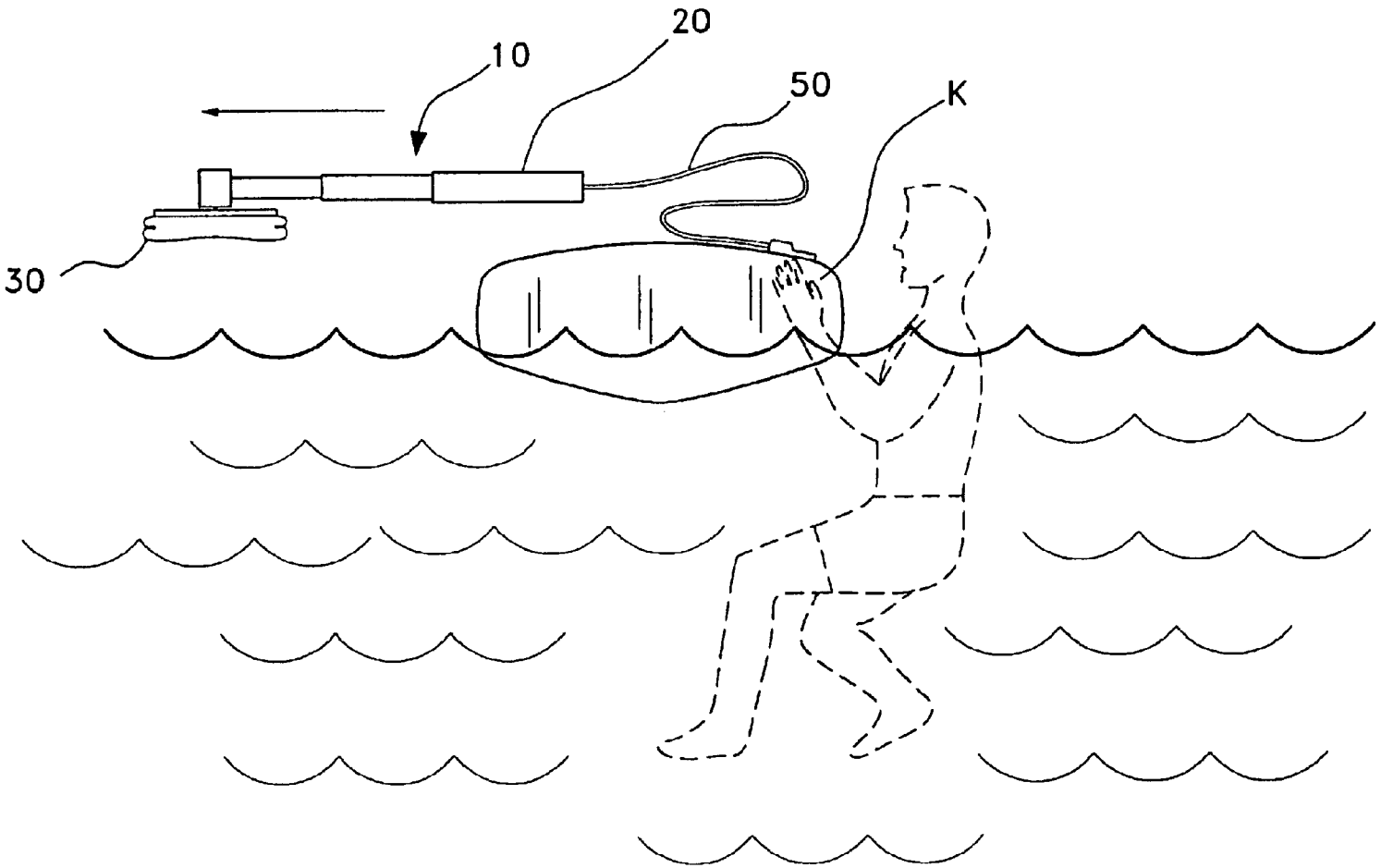
FIGS. 4A, 4B, 4C, 4D and 4E are diagrammatic views of a portable self-rescue device for kayakers being used with a user and his kayak.

FIGS. 4A, 4B, 4C, 4D and 4E show how a capsized kayaker would use the portable self-rescue device for a capsized kayak 10. As depicted in FIG. 4A, once a capsized kayaker is in the body of water, he or she would turn right the overturned kayak K (if needed) and would go to one side of the kayak K. Once on one of the sides of the kayak K, the capsized kayaker would unstrap the extendable telescopic arm 20 and the collapsible container 30 and throw them across to the other side of the kayak K. Due to the force of gravity, the extendible telescopic arm 20 will automatically extend fully, forming a lever against the kayak K itself. The entire water filled collapsible container 30 and the extendible telescopic arm 20 are manually drawn closer to the clam cleat 60 mounted to the opposite side of the kayak K using the first rope 50.

Figure 4B:
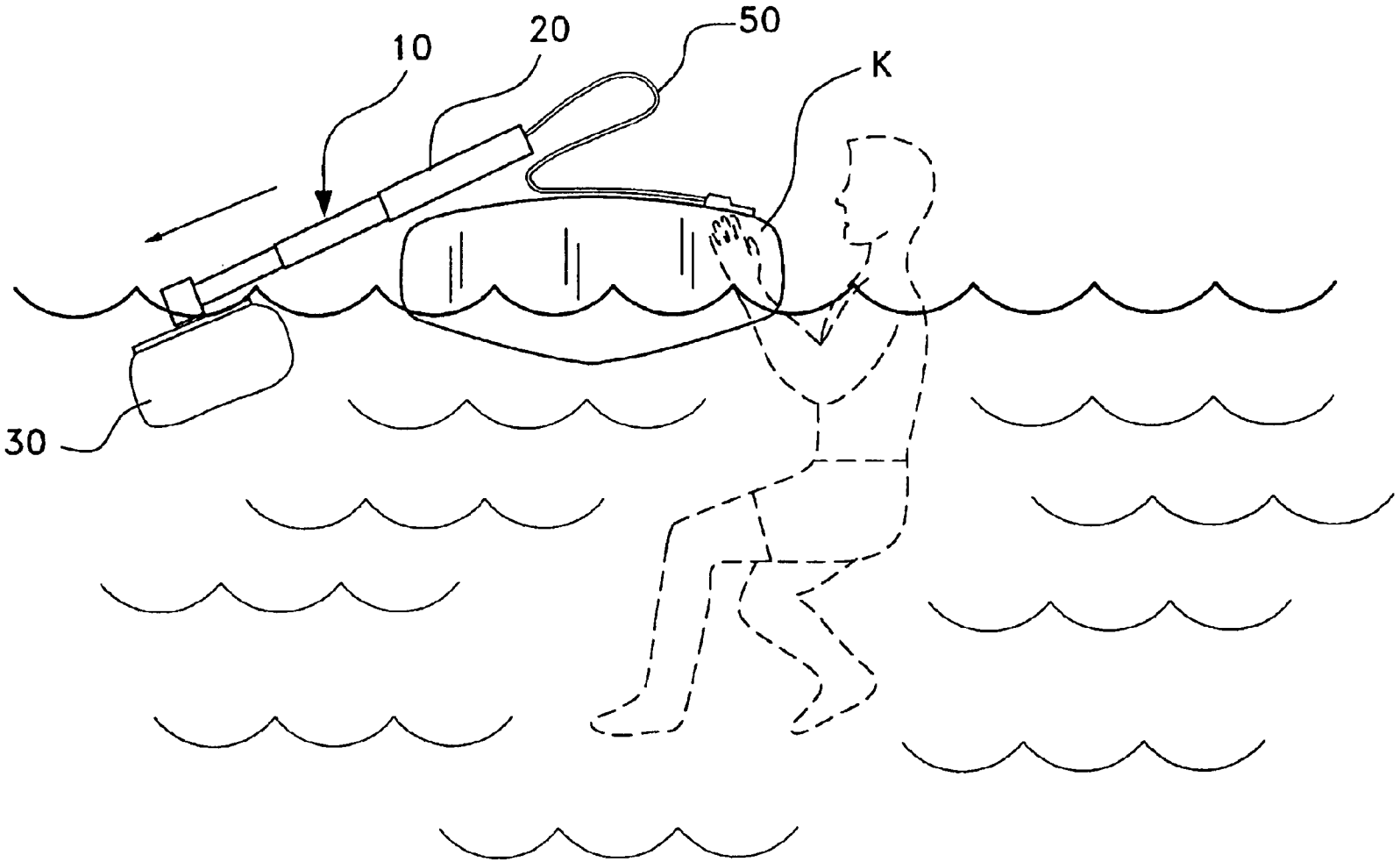
Figure 4C:
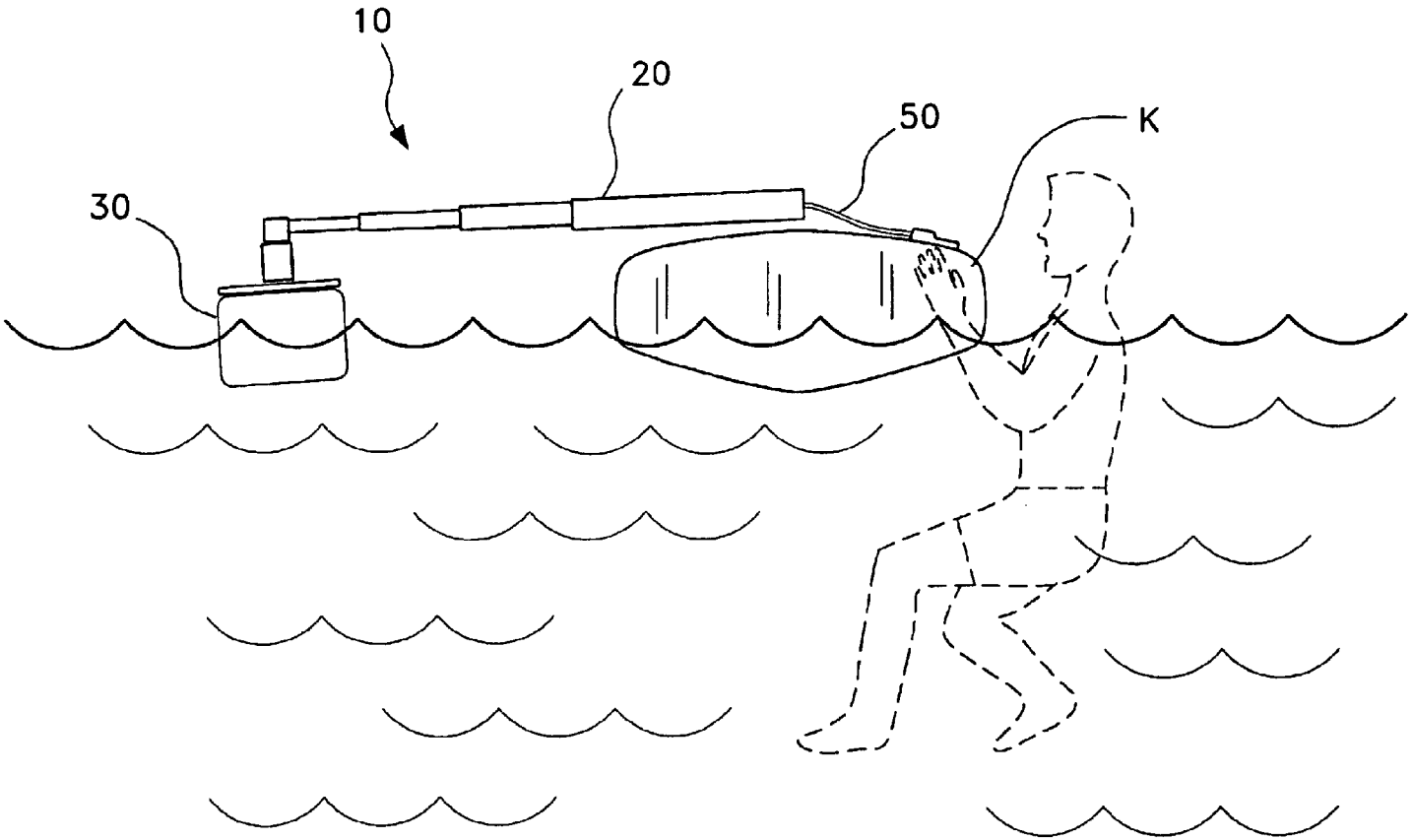

FIG. 4B and FIG. 4C illustrate that once the extendible telescopic arm 20 and collapsible container 30 are deployed across the kayak K, the collapsible container 30 will begin to take on water from the body of water. As the collapsible container 30 sinks from taking on the water, the first rope 50 keeps the collapsible container 30 from being lost and also secures the proximal end 22 of the extendible telescopic arm 20 to the kayak K, using a clam cleat 60. The collapsible container 30 now serves as a weight-bearing force on one end of the lever formed from the extendible telescopic arm 20.

Figure 4D:
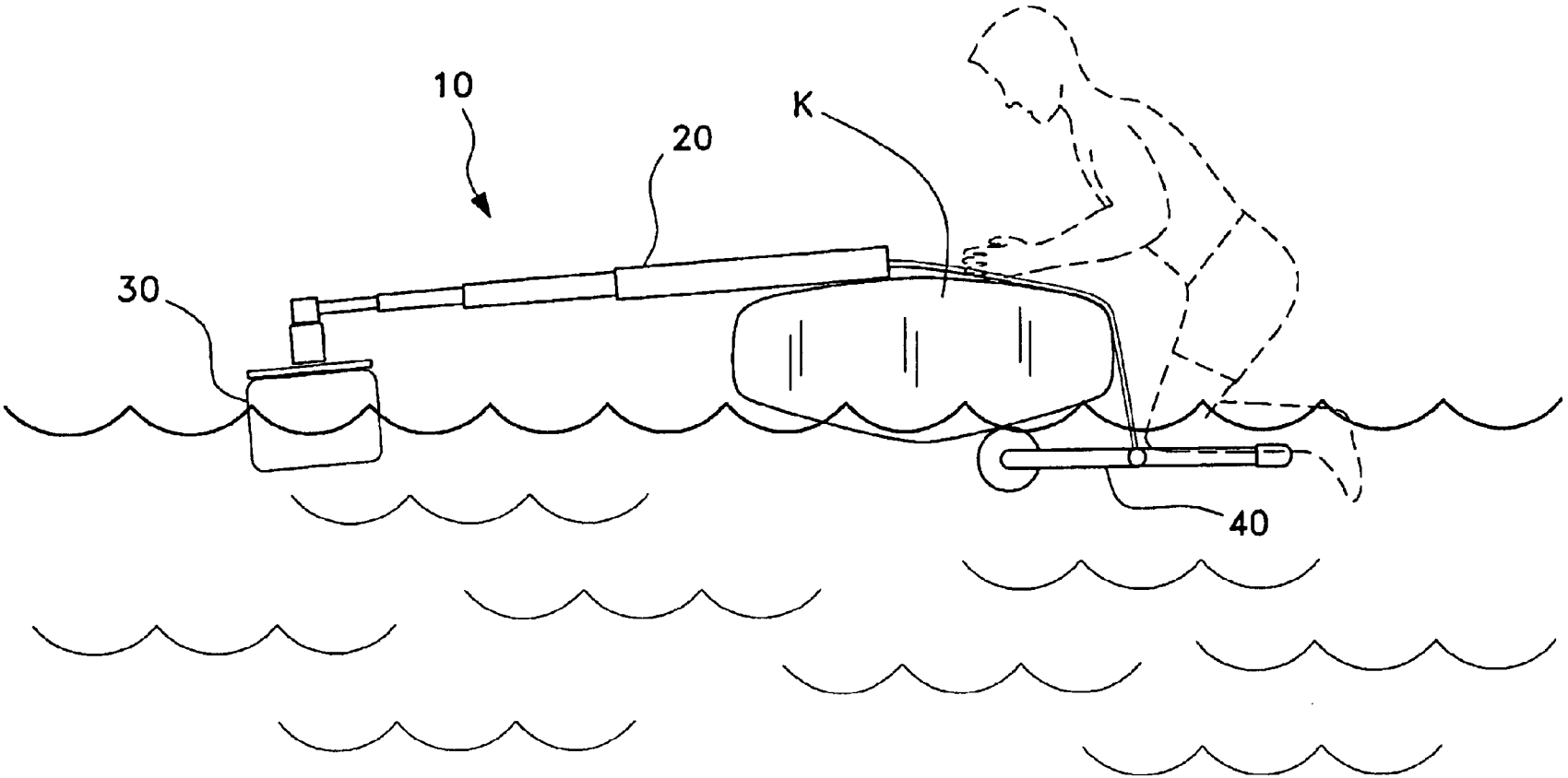
Figure 4E:
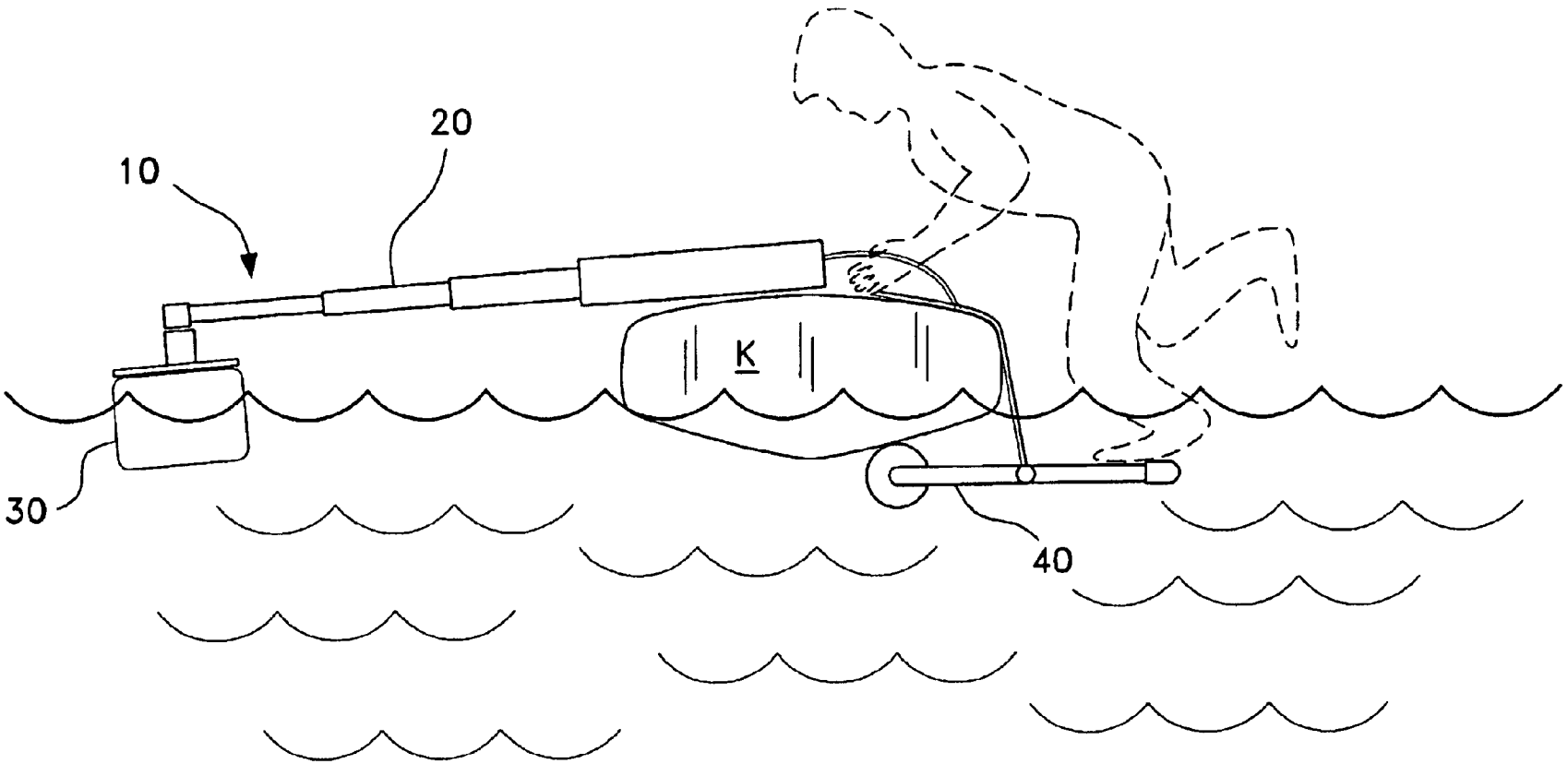

As is shown in FIG. 4D and FIG. 4E, the capsized kayaker can utilize the collapsible ladder platform assembly 40 from the top of the kayak K and place the collapsible ladder platform assembly 40 into the water. The floatation pad 110 of the collapsible ladder platform assembly 40 can be positioned underneath the kayak K, all the time being secured by the second rope 100. The capsized kayaker can now extend the second step 120 of the collapsible ladder platform assembly 40 and kneel or step onto the middle step 130 or the second step 120. The weight from the water collected in the collapsible container 30 is about 40 lbs. once it is filled and exerts an approximate 5:1 leverage advantage, allowing a 200 lbs. person (or more) to step onto the collapsible ladder platform assembly 40 without re-capsizing the kayak K. Once the kayaker has stepped or knelt on the collapsible ladder platform assembly 40, he or she can then crawl into the open cockpit of the kayak K. Once back in the kayak K, the kayaker can easily breakdown and store the portable self-rescue device for a capsized kayaker 10. This will include emptying the water from the collapsible container 30 and retracting the extendible telescopic arm 20 and collapsible ladder platform assembly 40. The collapsible container 30, the extendible telescopic arm 20 and the collapsible ladder platform assembly 40 can then be easily tied down on the top of a kayak K and reused again.

It is to be understood that the present invention is not limited to the embodiment described above, but encompasses any and all embodiments within the scope of the following claims.

I claim:

1. A portable self-rescue device for a capsized kayaker used in combination with a kayak, on a body of water, comprising:

an extendible telescopic arm with a proximal end and a distal end;

a collapsible container attached to the distal end of the extendible telescopic arm; and a collapsible ladder platform assembly with a retractable step, said capsized kayaker to throw and extend the extendible telescopic arm and collapsible container over and across the kayak and into the body of water, allowing the collapsible container to take on water and using the extendible telescopic arm as a lever, the filled collapsible container as a counterweight and the kayak as a fulcrum for the capsized kayaker to receive additional leverage and to get on the collapsible ladder platform assembly and back into the kayak.

2. The device according to claim 1, wherein a first rope that is attached to the proximal end of the extendible telescopic arm to the kayak is provided to prevent the extendible telescopic arm and attached collapsible container from floating away from the kayak while in the body of water.

3. The device according to claim 1, wherein the first rope that is attached to the proximal end of the extendible telescopic arm is provided to cinch the proximal end of the extendible telescopic arm to the clam cleat mounted firmly on the kayak.

4. The device according to claim 1, wherein a second rope that attaches the collapsible ladder platform to the kayak is provided to prevent the collapsible ladder platform assembly from floating away from the kayak while in the water and tightly secures the collapsible ladder platform assembly firmly to the kayak, wherein the entire collapsible ladder platform assembly can slide along the second rope for a desired deployed position along the side of the cockpit of the kayak.

5. The device according to claim 1, wherein a one way flapper valve is provided within the collapsible container that allows water from the body of water to rapidly fill into the collapsible container.

6. The device according to claim 1, wherein a lead weight is provided in the collapsible container to neutralize the slight positive buoyancy of the collapsible container material and to stabilize the proper orientation of the collapsible container as it lifts toward the surface of the water.

7. The device according to claim 1, wherein a floatation pad is provided on the collapsible ladder platform to prevent the collapsible ladder platform from sinking while in the body of water and provides a positive buoyant stabilization force to hold the floatation end of the collapsible ladder platform assembly underneath the kayak.

8. The device according to claim 1, wherein the collapsible container is attached to the distal end of the extendible telescopic arm with a plurality of grommets, a metallic ring and a Dacron™ cord.

* * * * *